United States Patent [19]

Hoashi et al.

[11] Patent Number: 4,549,466

[45] Date of Patent: Oct. 29, 1985

[54] SPLIT TYPE OIL HYDRAULIC PISTON PUMP AND PRESSURIZED OIL FEED CIRCUIT MAKING USE OF THE SAME PUMP

[75] Inventors: Kenzo Hoashi, Yokohama; Kazuo Uehara, Tokyo, both of Japan

[73] Assignee: Kabushiki Kaisha Komatsu Seisakusho, Tokyo, Japan

[21] Appl. No.: 604,106

[22] Filed: Apr. 26, 1984

[30] Foreign Application Priority Data

Apr. 27, 1983 [JP] Japan ..... 58-62093[U]
May 31, 1983 [JP] Japan ..... 58-81045[U]
May 31, 1983 [JP] Japan ..... 58-94882

[51] Int. Cl.[4] ..... F04B 27/06; F04B 1/22

[52] U.S. Cl. ..... 91/6.5; 60/421; 60/484

[58] Field of Search ..... 417/225; 91/499, 503–507, 91/6.5; 60/421, 484

[56] References Cited

U.S. PATENT DOCUMENTS

| | | | |
|---|---|---|---|
| 1,714,148 | 5/1929 | Weedy | 91/505 |
| 2,452,470 | 10/1948 | Johnson | 417/225 |
| 2,797,551 | 7/1957 | Adams et al. | 60/421 |
| 2,832,199 | 4/1958 | Adams et al. | 60/484 |
| 3,093,079 | 6/1963 | Graham | 91/474 |
| 3,128,707 | 4/1964 | Brundage | 417/15 |
| 3,232,056 | 1/1966 | Heinrich et al. | 60/484 |
| 4,077,746 | 3/1978 | Reynolds | 417/225 |

FOREIGN PATENT DOCUMENTS

| | | | |
|---|---|---|---|
| 16620 | 7/1969 | Japan | 417/312 |
| 35304 | 3/1977 | Japan | 91/6.5 |

*Primary Examiner*—William L. Freeh
*Attorney, Agent, or Firm*—Armstrong, Nikaido, Marmelstein & Kubovcik

[57] ABSTRACT

The known swash plate type oil hydraulic piston pump is improved in that three delivery slots each extending over an angular distance of about 60° are formed in a valve plate along one circumference concentric with a rotary cylinder block at an angular interval of 60° and the number of piston-cylinder units provided in the cylinder block is chosen to be a multiple of 6. Pressurized oil delivered through a center delivery slot is fed to one hydraulic actuator, and pressurized oil delivered through the delivery slots on the opposite sides of the center delivery slot is jointly fed to the other hydraulic actuator, whereby variations of flow rates of the pressurized oil fed to the respective hydraulic actuators can be minimized. Preferably, in order to feed more pressurized oil to a more heavily loaded hydraulic actuator, additional delivery slots are formed in the valve plate at the boundary portions between the three main delivery slots, and pressurized oil delivered through these additional delivery slots is fed selectively to a more heavily loaded hydraulic actuator or, if the both actuators are equally loaded, to both the hydraulic actuator through a pressure-sensitive switching valve. More preferably, a pulsation damper is connected across the hydraulic circuits for feeding the pressurized oil to the respective hydraulic actuators.

2 Claims, 11 Drawing Figures

SPLIT TYPE OIL HYDRAULIC PISTON PUMP AND PRESSURIZED OIL FEED CIRCUIT MAKING USE OF THE SAME PUMP

BACKGROUND OF THE INVENTION

1. Field of the Invention

The present invention relates to a split type oil hydraulic piston pump and a pressurized oil feed circuit for feeding pressurized oil to two hydraulic actuators by making use of a split type oil hydraulic piston pump.

2. Description of the Prior Art

Heretofore, generally classifying the oil hydraulic piston pumps, axial type oil hydraulic piston pumps and radial type oil hydraulic pumps have been known, and as oil hydraulic piston pumps adapted for high-speed, high-pressure and variable-capacity operations the axial type oil hydraulic piston pumps have been commonly used. In these axial type oil hydraulic piston pumps is included a swash plate type piston pump which is also known as a KV pump. Among these swash plate type piston pumps, a piston pump constructed in such manner that a single pressurized oil suction slot and a plurality of pressurized oil delivery slots are formed in one valve plate that is slidably making contact with a single cylinder block provided with a plurality of pistons and pressured oil may be fed from these delivery slots to a plurality of hydraulic actuators, is known as a split type oil hydraulic pump.

A difficulty associated with such a split type oil hydraulic pump in the prior art was generation of a large variation of a flow rate when the pistons deliver the pressurized oil to the respective delivery slots. In addition, when each piston passes through the valve plate portion between the plurality of delivery slots, the delivered oil is interrupted by the valve plate, resulting in generation of a large trapping pressure, and hence the oil delivered from the piston cannot be effectively and perfectly utilized. Furthermore, in the case where the pressurized oil is fed from the plurality of pressurized oil delivery slots to a plurality of hydraulic actuators, it is necessary to feed a larger amount of pressurized oil to a hydraulic actuator that is more heavily loaded. Moreover, the larger a load of a hydraulic actuator is, the more is generated oil leakage.

SUMMARY OF THE INVENTION

The present invention has been worked out in view of the above-mentioned status of the prior art, and a principal object of the present invention is to provide a split type oil hydraulic piston pump, in which a large variation of a flow rate would not be generated when the respective pistons deliver the pressurized oil to the respective delivery slots.

Another object of the present invention is to provide a pressurized oil feed circuit system for use with a split type oil hydraulic piston pump, in which a larger amount of pressurized oil can be fed to a hydraulic actuator that is more heavily loaded.

Still another object of the present invention is to provide a split type oil hydraulic piston pump, in which a trapped pressure produced when each piston passes through a valve plate portion between a plurality of delivery slots can be avoided as much as possible and moreover the oil delivered from each piston can be effectively utilized to the maximum extent, and a pressurized oil feed circuit system making use of the same pump.

Yet another object of the present invention is to provide a pressurized oil feed circuit system making use of a split type oil hydraulic piston pump, which system can prevent an oil flow rate fed to a hydraulic actuator from increasing abruptly.

In order to achieve the aforementioned various objects of the invention, according to a first aspect of the present invention, there is provided a split type oil hydraulic piston pump including a plurality of piston-cylinder units disposed within a single cylinder block along one circumference at an equal angular interval and in parallel to each other and a valve plate disposed on the pressurized oil suction/delivery side of these piston-cylinder units so as to make slidable contact with the above-mentioned cylinder block and having a single suction slot and a plurality of delivery slots, in which the plurality of delivery slots are disposed along the above-mentioned one circumference as spaced by an angular interval of 60° from each other, and the plurality of piston-cylinder units are provided as many as a multiple of 6.

According to a second aspect of the present invention, there is provided a split type oil hydraulic piston pump according to the above-mentioned first aspect of the invention, in which the valve plate is further provided with outlet slots serving as additional delivery slots between adjacent delivery slots among the plurality of delivery slots.

According to a third aspect of the present invention, there is provided a pressurized oil feed circuit system making use of a split type oil hydraulic piston pump for connecting first and second hydraulic actuators with a split type oil hydraulic piston pump including a plurality of piston-cylinder units disposed within a single cylinder block along one circumference at an equal angular interval and in parallel to each other and a valve plate disposed on the pressurized oil suction/-delivery side of the piston-cylinder units so as to make slidable contact with the above-mentioned cylinder block and having a single suction slot and first, second and third delivery slots disposed along the above-mentioned one circumference as spaced by an angular interval of 60° from each other, the plurality of piston-cylinder units being provided as many as a multiple of 6, which system comprises a first circuit for connecting the above-mentioned first and third delivery slots jointly to the above-mentioned first hydraulic actuator and a second circuit for connecting the above-mentioned second delivery slot to the above-mentioned second hydraulic actuator.

According to a fourth aspect of the present invention, there is provided a pressurized oil feed circuit system making use of a split type oil hydraulic piston pump for connecting first and second hydraulic actuators with a split type oil hydraulic piston pump including a plurality of piston-cylinder units disposed within a single cylinder block along one circumference at an equal angular interval and in parallel to each other and a valve plate disposed on the pressurized oil suction/-delivery side of the piston-cylinder units so as to make slidable contact with the above-mentioned cylinder block and having a single suction slot and first, second and third delivery slots disposed along the above-mentioned one circumference as spaced by an angular interval of 60° from each other, the plurality of piston-cylinder units being provided as many as a multiple of 6, which system comprises a first circuit for connecting the above-mentioned first and third delivery slots jointly to the above-mentioned first hydraulic actuator, a second circuit for connecting the above-mentioned second delivery slot to the above-mentioned second actuator, and first and second outlet slots formed in the valve plate between the above-mentioned first and second delivery slots and between the above-mentioned second and third delivery slots, respectively, said first and second outlet slots being jointly and selectively connected to either one having a higher pressure of the above-mentioned first and second circuits or to both the first and second circuits if they have an equal pressure, via one switching valve.

According to a fifth aspect of the present invention, there is provided a pressurized oil feed circuit system according to the above-mentioned fourth aspect of the invention, in which the circuit for connecting the above-mentioned first and second outlet slots to the above-mentioned switching valve is provided with check valve means.

According to a sixth aspect of the present invention, there is provided a pressurized oil feed circuit system according to the above-mentioned fourth or fifth aspect of the invention, which system comprises a pulsation damper connected between the most downstream ends of the aforementioned first and second circuits for feeding pressurized oil to the above-mentioned first and second hydraulic actuators, respectively.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

Figure 1:
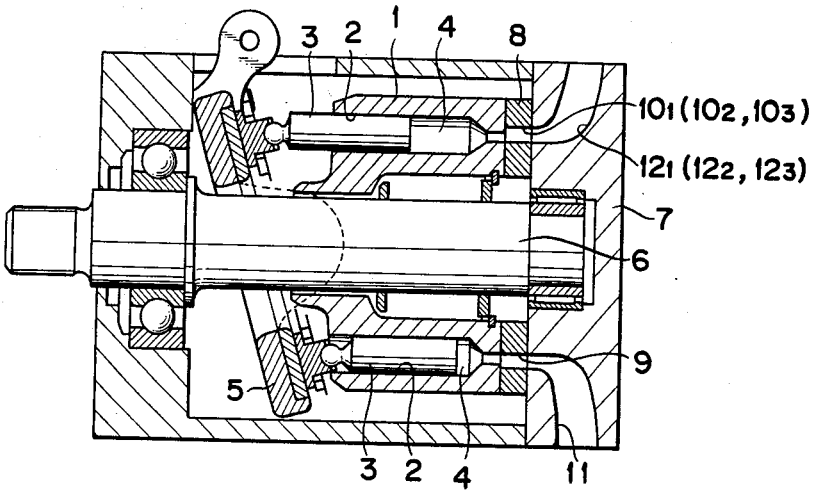
FIG. 1 is a schematic longitudinal cross-section view of one embodiment of a split type oil hydraulic piston pump according to the present invention.
Figure 2:
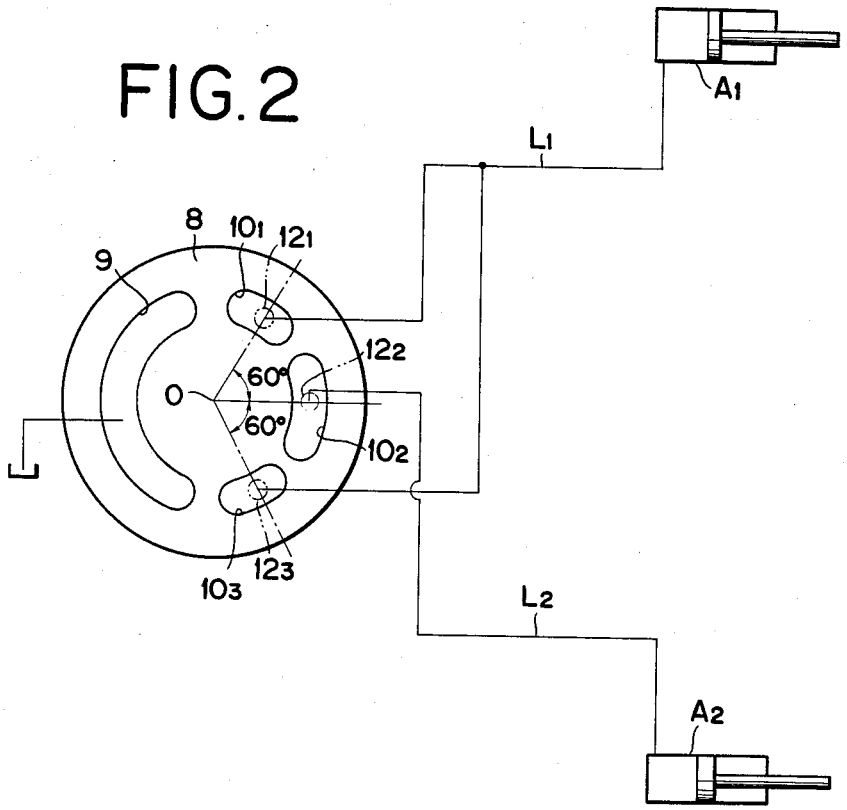
FIG. 2 is a schematic plan view of one embodiment of a valve plate to be used in a split type oil hydraulic piston pump according to the present invention and a hydraulic circuit diagram of one embodiment of a pressurized oil feed circuit for hydraulic actuators according to the present invention, in combination.

At first, a first embodiment of a split type oil hydraulic piston pump according to the present invention and a first embodiment of a pressurized oil feed circuit to be used jointly with the split type oil hydraulic piston pump will be described with reference to FIGS. 1 and 2.

Reference numeral 1 designates a cylinder block adapted to be rotated jointly with a rotary shaft 6. In this cylinder block 1 are formed a plurality of cylinder bores 2 as arrayed along a concentric circumference at an equal angular interval and in parallel to each other, pistons 3 are respectively fitted in these cylinder bores 2 so as to make slidable contact with the bore inner surfaces to form respective cylinder chambers 4, and the respective pistons 3 are coupled to a swash plate 5. In addition, between the cylinder block 1 and a valve body 7 is disposed a valve plate 8, and in this valve plate 8 are formed a suction slot 9 extending nearly over a semi-circumference and first, second and third delivery slots $\mathbf{10}_1$, $\mathbf{10}_2$ and $\mathbf{10}_3$ as aligned along the same circumference. On the other hand, in the valve body 7 are formed a suction port 11 opening to the suction slot 9, a first delivery port $\mathbf{12}_1$ opening to the first delivery slot $\mathbf{10}_1$, a second delivery port $\mathbf{12}_2$ opening to the second delivery slot $\mathbf{10}_2$ and a third delivery port $\mathbf{12}_3$ opening to the third delivery slot $\mathbf{10}_3$. The first delivery port $\mathbf{12}_1$ and the third delivery port $\mathbf{12}_3$ are jointly connected to a first hydraulic actuator $A_1$ through a first circuit $L_1$, and the second delivery port $\mathbf{12}_2$ is connected to a second hydraulic actuator $A_2$ through a second circuit $L_2$. The first, second and third delivery slots $\mathbf{10}_1$, $\mathbf{10}_2$ and $\mathbf{10}_3$ are formed so as to be arrayed along one circumference having its center at a center O of the valve plate 8 as spaced by an angular interval of 60° from each other, and the number of the pistons 3 is equal to a multiple of 6 (6, 12, 18, . . . ). As a result of the above-mentioned arrangement, a variation of a flow rate of pressurized oil fed to each hydraulic actuator by the pistons 3 can be reduced. The reason for the reduction of the flow rate variation will be explained in the following.

Figure 3:
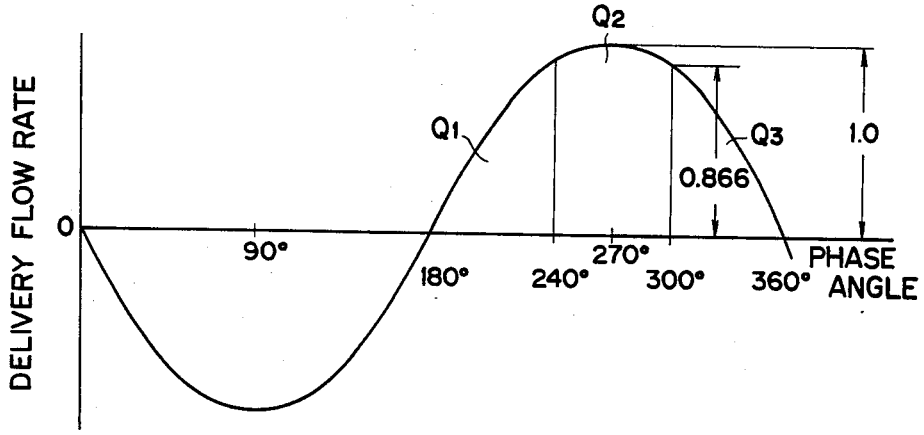
FIG. 3 is a graph showing a theoretical delivery flow rate of a single piston-cylinder unit in a piston pump.

Since a theoretical instantaneous delivery rate per one piston 3 depicts a sine curve as shown in FIG. 3, in order to equalize a sum of delivery amounts $Q_1$ and $Q_3$ per one cycle of the first and third delivery slots $\mathbf{10}_1$ and $\mathbf{10}_3$ to a delivery amount $Q_2$ per one cycle of the second delivery slot $\mathbf{10}_2$, it is only necessary to form the first delivery slot $\mathbf{10}_1$ over the range of 180° to 240°, the second delivery slot $\mathbf{10}_2$ over the range of 240° to 300° and the third delivery slot $\mathbf{10}_3$ over the range of 300° to 360°, and hence the first, second and third delivery slots $\mathbf{10}_1$, $\mathbf{10}_2$ and $\mathbf{10}_3$ could be formed in the valve plate 8 along one circumference as spaced by an angular interval of 60° from each other.

Figure 4:
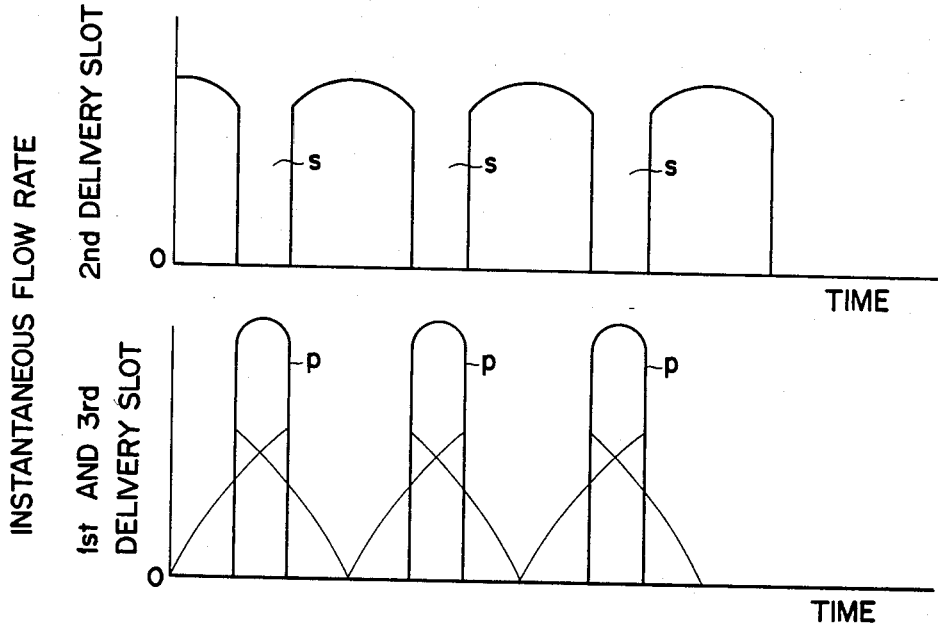
FIGS. 4 to 7 are graphs showing instantaneous flow rates of pressurized oil through a second delivery slot and instantaneous flow rates of pressurized oil through first and third delivery slots in combination, respectively.
Figure 5:
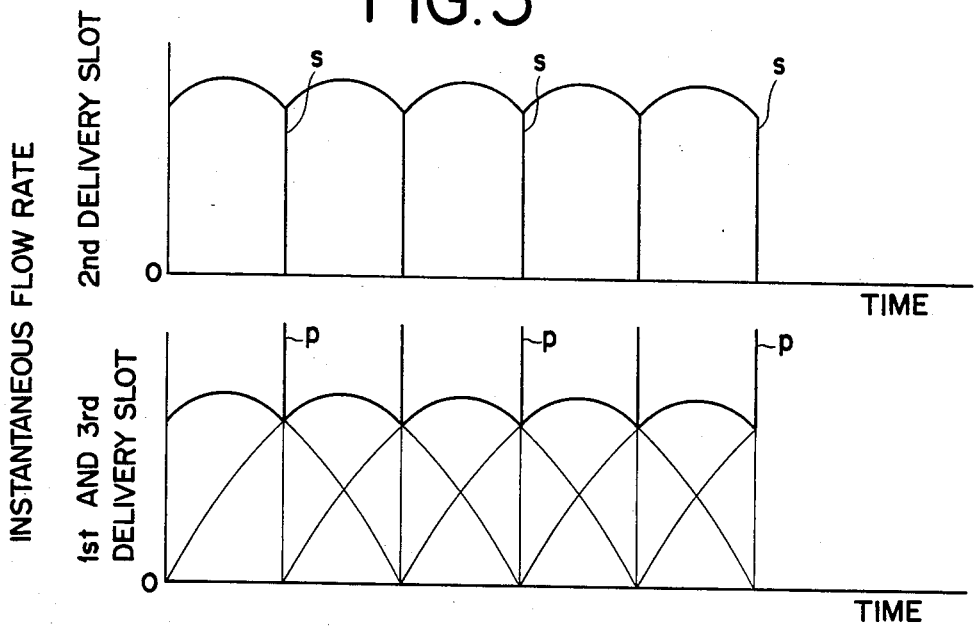

In the above-described split type oil hydraulic piston pump, variations of instantaneous flow rates through the second delivery slot $\mathbf{10}_2$ and through the first and third delivery slots $\mathbf{10}_1$ and $\mathbf{10}_3$ in combination when the number of the pistons 3 is smaller than 6 and when the number of the pistons 3 is equal to 6, respectively, are shown by the graphs in FIGS. 4 and 5, in which in the case where the number of the pistons 3 is smaller than 6, slits s and peaks p are generated in the flow rate waveforms, resulting in a large variation of a flow rate (FIG. 4), but when the number of the pistons 3 is selected to be 6, the slits s and peaks p in the flow rate waveforms become extremely small and hence a flow rate variation can be reduced (FIG. 5).

Figure 6:
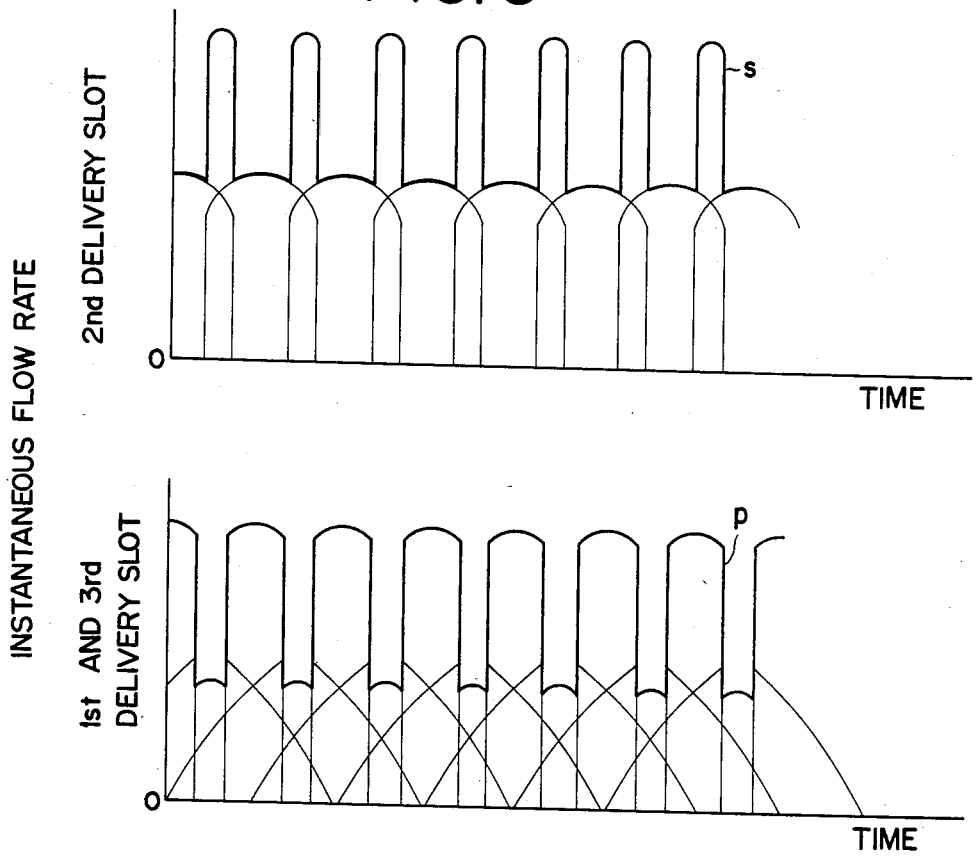
Figure 7:
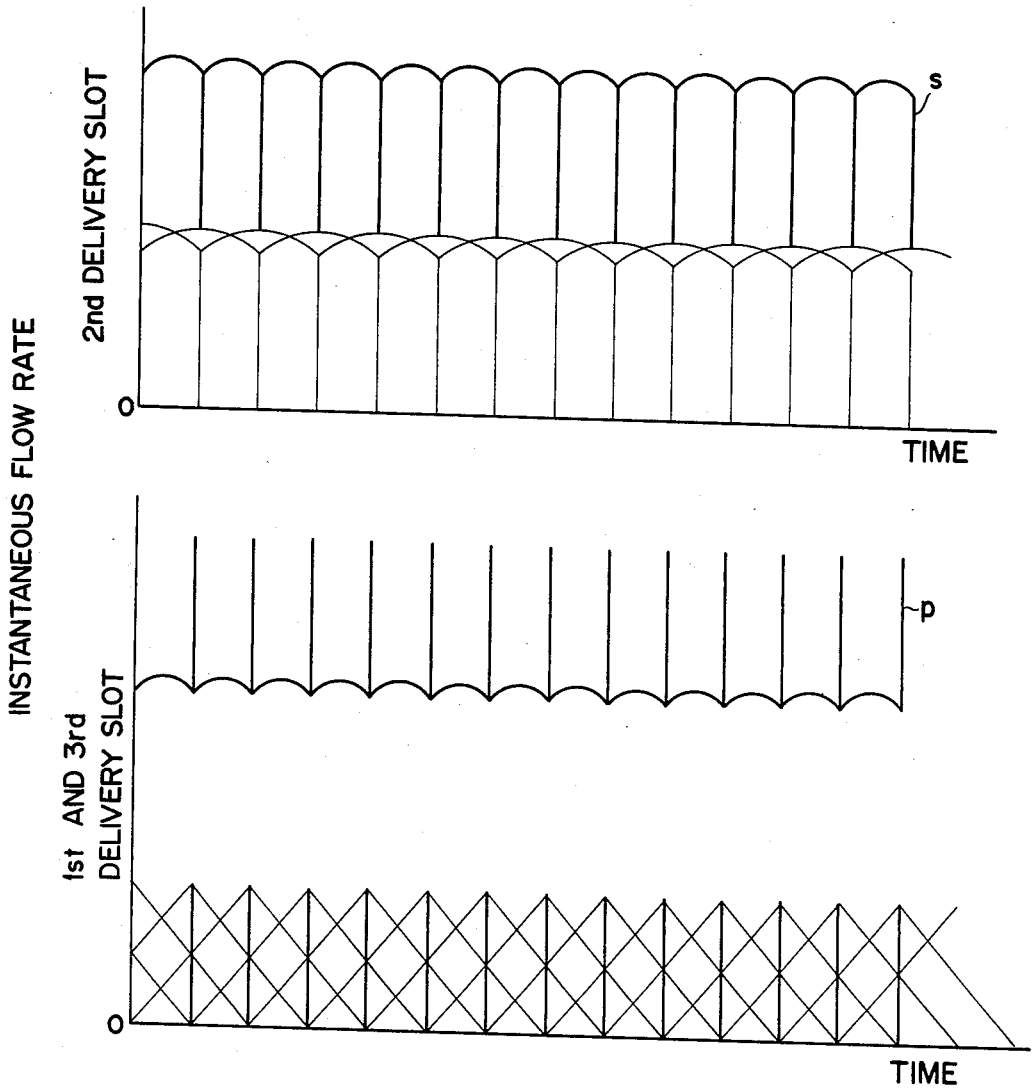

More particularly, when the number of the pistons 3 is selected to be 6, the variations of the theoretical instantaneous delivery rates for the respective ones of the successive pistons 3 as shown in FIG. 3 would appear as delayed by a phase angle of 360°/6=60° successively so as to deliver the pressurized oil by the amounts per one cycle of $Q_1$, $Q_2$ and $Q_3$, respectively, through the first, second and third delivery slots $10_1$, $10_2$ and $10_3$, and hence the slits s and peaks p in the resultant flow rate waveforms would become small as shown in FIG. 5, whereas when the number of the piston 3 is smaller than 6, the variations of the theoretical instantaneous delivery rates for the respective ones of the successive pistons as shown in FIG. 3 would appear as delayed by a phase angle larger than 60° successively so as to deliver the pressurized oil by the amounts per one cycle of $Q_1$, $Q_2$ and $Q_3$, respectively, through the first, second and third delivery slots $10_1$, $10_2$ and $10_3$, and so, the slits s and peaks p in the resultant flow rate waveforms would become large as shown in FIG. 4. In addition, when the number of the pistons 3 is chosen to be larger than 6 and smaller than 12, and when it is chosen to be equal to 12, the resultant delivery flow rates through the second delivery slot $10_2$ and through the first and third delivery slots $10_1$ and $10_3$ in combination, respectively, are shown by the graphs in FIGS. 6 and 7, in which it is observed that when the number of the pistons 3 is larger than 6 and smaller than 12, the slits s and peaks p in the resultant flow rate waveforms would become large similarly to the above-mentioned case where the number of the pistons 3 is smaller than 6, and when it is chosen to be 12, the slits s and peaks p would become smaller than the above-mentioned case where it is chosen to be 6. If the number of the pistons 3 is selected to be 18, then the slits s and peaks p in the resultant flow rate waveforms would become further small. However, when the number of the pistons 3 is increased up to 18, the overall size of the piston pump would become large, and yet the effect obtained by increasing the number of the pistons so large, is small. Therefore, the number of 12 is most preferable.

Subsequently, another embodiment of the abovedescribed valve plate 8 and the pressurized oil feed circuit will be described with reference to FIG. 8.

Figure 8:
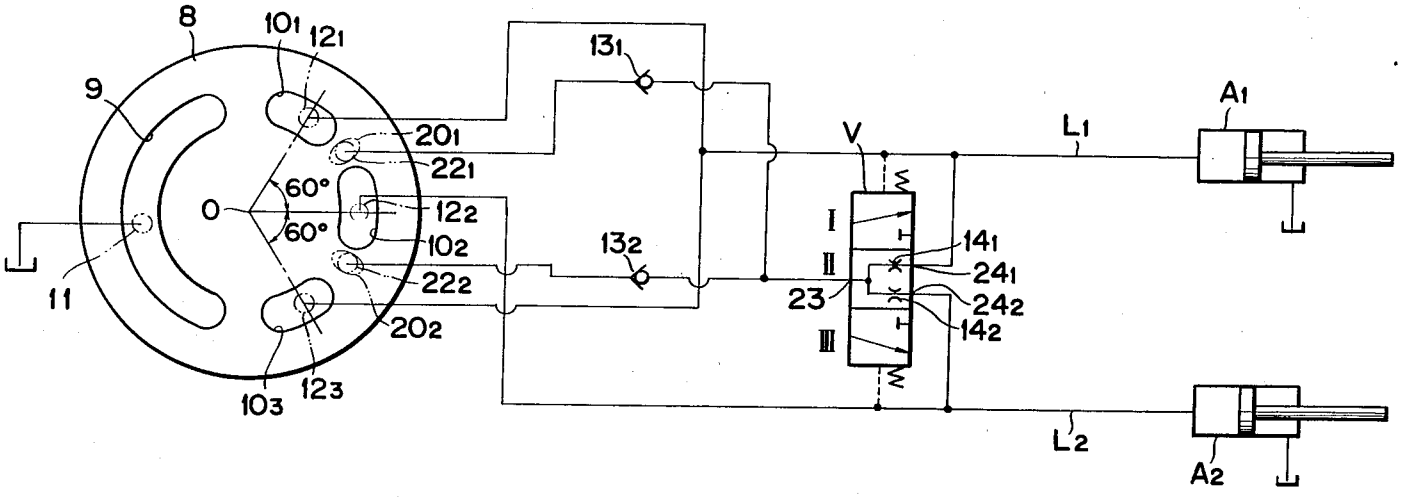
FIG. 8 is a schematic plan view of another embodiment of a valve plate to be used in a split type oil hydraulic pump according to the present invention and a hydraulic circuit diagram of another embodiment of a pressurized oil feed circuit for hydraulic actuators according to the present invention, in combination.

As shown in FIG. 8, in addition to the first, second and third delivery slots $10_1$, $10_2$ and $10_3$, the valve plate 8 is provided with first and second outlet slots $20_1$ and $20_2$ serving similarly to the delivery slots, between the first and second delivery slots $10_1$ and $10_2$ and between the second and third delivery slots $10_2$ and $10_3$, respectively. The locations where these first and second outlet slots $20_1$ and $20_2$ are provided, correspond to the positions where a trapping pressure is produced by the piston 3 in the case of the above-described first embodiment, and in terms of the rotational phase angle of the cylinder block the locations correspond to the points of 240° and 300° as viewed in FIG. 3. In a pressurized oil feed circuit for first and second hydraulic actuators $A_1$ and $A_2$ to be connected to this valve plate 8 according to the second embodiment, as shown in FIG. 8, a first delivery port $12_1$ opening to the first delivery slot $10_1$ and a third delivery port $12_3$ opening to the third delivery slot $10_3$ are connected via a first circuit $L_1$ to the first hydraulic actuator $A_1$, a second delivery port $12_2$ opening to the second delivery slot $10_2$ is connected via a second circuit $L_2$ to the second hydraulic actuator $A_2$, a first outlet port $22_1$ opening to the above-mentioned first outlet slot $20_1$ and a second outlet port $22_2$ opening to the above-mentioned second outlet slot $20_2$ are connected via check valves $13_1$ and $13_2$, respectively, to an inlet port 23 of a switching valve V, and further led to two outlet ports $24_1$ and $24_2$ of the switching valve V via chokes $14_1$ and $14_2$ provided within the switching valve V when the switching valve V takes a neutral position or to either one of the two outlet ports $24_1$ and $24_2$ when the switching valve V is actuated in either direction, and thus eventually, the first and second outlet slots $20_1$ and $20_2$ are jointly and selectively connected to either one or both of the above-mentioned first and second circuits $L_1$ and $L_2$.

The above-described switching valve V is normally held, by resilient forces of associated biasing springs, at a first position I for feeding pressurized oil delivered from the first and second outlet ports $22_1$ and $22_2$ to the first and second circuits $L_1$ and $L_2$ through the chokes $14_1$ and $14_2$, respectively. However, in the event that the oil pressure in the first circuit $L_1$ is higher than the oil pressure in the second circuit $L_2$, the switching valve V occupies a second position II for feeding pressurized oil delivered from the first and second outlet ports $22_1$ and $22_2$ to the first circuit $L_1$, while in the event that the oil pressure in the second circuit $L_2$ is higher than the oil pressure in the first circuit $L_1$, the switching valve V occupies a third position III for feeding pressurized oil delivered from the first and second outlet ports $22_1$ and $22_2$ to the second circuit $L_2$.

Since the pressurized oil feed circuit system shown in FIG. 8 is constructed in the above-described manner, the circuit $L_1$ or $L_2$ on the side of the hydraulic actuator $A_1$ or $A_2$ that is more heavily loaded is additionally fed with pressurized oil delivered from the first and second outlet ports $22_1$ and $22_2$, and thereby the pressurized oil can be fed at a larger flow rate to the hydraulic actuator that is more heavily loaded. Therefore, the hydraulic actuator that is more heavily loaded, can be operated at a high speed and at a high pressure, and also leakage of pressurized oil in the more heavily loaded hydraulic actuator can be compensated. It is to be noted that in the case where the oil pressures in the first and second circuits $L_1$ and $L_2$ are equal to each other, the switching valve V is held at the first position I, where it feeds the pressurized oil delivered from the first and second outlet ports $22_1$ and $22_2$ to the first and second circuits $L_1$ and $L_2$ via the chokes $14_1$ and $14_2$, respectively, at equal flow rates.

Moreover, according to the construction of the above-described second embodiment, pressurized oil trapped at the valve plate portions between the delivery slots in the split type piston pump can be fed through the first and second outlet slots $20_1$ and $20_2$ to either one having a higher pressure or both of the first and second circuits $L_1$ and $L_2$. Accordingly it becomes possible to reduce the trapping pressure, and hence it is possible to obviate the disadvantages of the split type oil hydraulic piston pump in the prior art that the output pressure is lowered and the power loss caused by leakage of pressurized oil is increased.

Here it is to be noted that the aperture area $A_s$ of the outlet slots $20_1$ and $20_2$ is determined in the following manner. Since the theoretical instantaneous delivery rate per one piston produced as a result of rotation of the cylinder block 1 would vary as shown in FIG. 3 as described above, it will be readily seen that the oil flow rate through the outlet slots $\mathbf{20}_1$ and $\mathbf{20}_2$ disposed at the positions of rotational phase angles of 240° and 300° is 0.866 times as large as the maximum delivery flow rate per one piston. Accordingly, it is preferable to select the aperture area $A_s$ of the outlet slots $\mathbf{20}_1$ and $\mathbf{20}_2$ to be 0.866 times as large as the outlet aperture area $A_p$ of the cylinder chamber 4.

Figure 9:
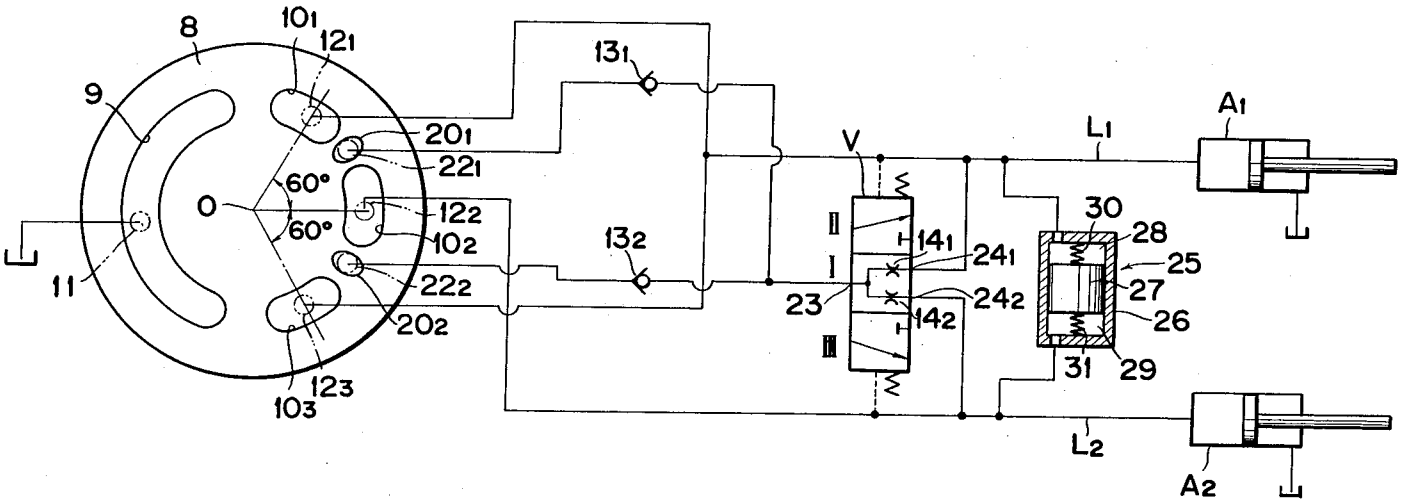
FIG. 9 is a hydraulic circuit diagram of still another embodiment of a pressurized oil feed circuit according to the present invention in combination with a schematic plan view of a valve plate similar to that shown in FIG. 8.
Figure 10:
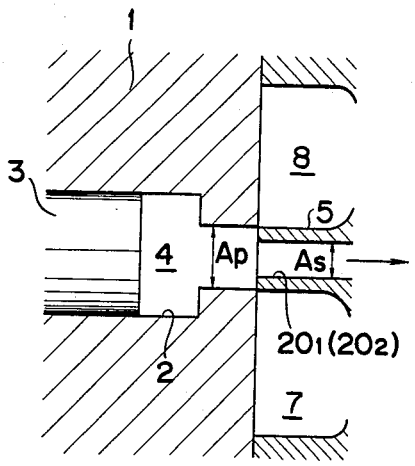
FIG. 10 is an enlarged cross-section view, partly cut away, showing an outlet slot portion of a split type oil hydraulic piston pump according to the present invention.

A third embodiment of the above-described pressurized oil feed circuit is illustrated in FIG. 9. According to this embodiment, a pulsation damper 25 is provided across the first and second circuits $L_1$ and $L_2$ as connected to the downstream of the respective circuits on the side of the hydraulic actuators.

This pulsation damper 25 is constructed in such manner that a free piston 27 is provided within a cylinder 26 so as to form first and second hydraulic chambers 28 and 29 and the free piston 27 is held at a neutral position by means of first and second springs 30 and 31. The first and second hydraulic chambers 28 and 29 are respectively connected to the first circuit $L_1$ and the second circuit $L_2$. Therefore, in the event that the flow rate through either one of the first and second circuits $L_1$ and $L_2$ has been momentarily and impulsively increased, then the increment of the oil flow is fed to the corresponding one of the first and second hydraulic chambers 28 and 29 and urges the free piston 27 towards the opposite end of the cylinder 26 against the resilient force of the first and second springs 30 and 31, so that the impulsive variation of the oil feed rate through the circuit $L_1$ or $L_2$ can be obviated.

In the case where means for allowing a trapping pressure to escape is provided, a variation of an instantaneous oil flow rate corresponding to about 50% of an average delivery rate of all the working pistons 3, must be absorbed (although this is a specific value in the case where the number of the pistons is 12). This amount of absorption is sufficiently approximated, in terms of a volume change, by about 10% of a stroke of one piston, and hence the pulsation damper 25 is only necessitated to have a capacity equal to about 1/10 times that of the piston 3, so long as it has a response of about 500 Hz. In other words, if it is assumed that the diameter of the piston 3 and the diameter of the free piston 27 are identical and the response of the pulsation damper is 500 Hz, the stroke of the free piston 28 could be selected to be about 1/10 times the stroke of the piston 3.

Figure 11:
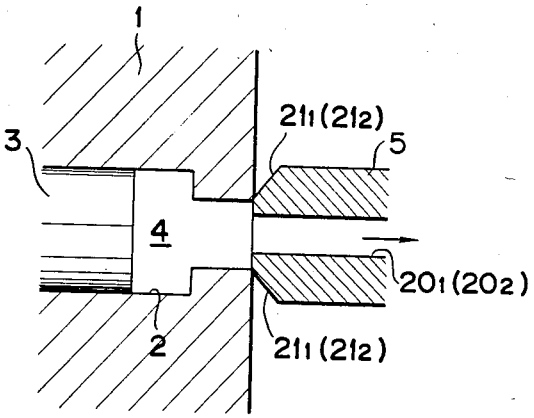
FIG. 11 is an enlarged cross-section view, partly cut away, showing another embodiment of the outlet slot portion.

In addition, as shown in FIG. 11, notches $\mathbf{21}_1$ and $\mathbf{21}_2$ could be formed in the outlet slots $\mathbf{20}_1$ and $\mathbf{20}_2$, respectively, for the purpose of reducing noises and improving a mechanical strength of the outlet slot portions.

What is claimed is:

1. In a split type oil hydraulic piston pump including a plurality of piston-cylinder units disposed within a single cylinder block along a circumference thereof at equal angular intervals and in parallel with each other, and a valve plate disposed on the pressurized oil suction/delivery side of these piston units so as to make slidable contact with said cylinder block, the improvement comprising providing said valve plate with a single suction slot and a plurality of delivery slots, said plurality of delivery slots being disposed along said circumference spaced by an angular interval of 60° from each other, said valve plate being further provided with outlet slots serving as additional delivery slots between adjacent delivery slots of said plurality of delivery slots, and wherein said plurality of piston-cylinder units is a number as high as a multiple of 6.

2. A pressurized oil feed circuit system for connecting first and second hydraulic actuators with a split type oil hydraulic piston pump including a plurality of piston-cylinder units disposed within a single cylinder block along a circumference thereof at equal angular intervals and in parallel with each other and a valve plate disposed on the pressurized oil suction/delivery side of said pistion-cylinder units so as to make slidable contact with said cylinder block and having a single suction slot and first, second and third delivery slots disposed along said circumference spaced by an angular interval of 60° from each other, said plurality of piston-cylinder units being a number as high as a multiple of 6, said system comprising a first circuit for connecting said first and third delivery slots jointly to said first hydraulic actuator, a second circuit for connecting said second delivery slot to said second hydraulic actuator, first and second outlet slots formed in said valve plate between said second and third delivery slots, respectively, said first and second outlet slots being jointly and selectively connected either to the one of said first and second circuits having a higher pressure or to both said first and second circuits when said first and second circuits have an equal pressure, via a switching valve, and a pulsation damper connected between the most downstream ends of said first and second circuits for feeding pressurized oil to said first and second hydraulic actuators, respectively.

* * * * *